US009157342B2

(12) United States Patent
Kato

(10) Patent No.: US 9,157,342 B2
(45) Date of Patent: Oct. 13, 2015

(54) VALVE TIMING CONTROL APPARATUS FOR INTERNAL COMBUSTION ENGINE

(71) Applicant: HITACHI AUTOMOTIVE SYSTEMS, LTD., Hitachinaka-shi, Ibaraki (JP)

(72) Inventor: Hiroyuki Kato, Kanagawa (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 14/051,136

(22) Filed: Oct. 10, 2013

(65) Prior Publication Data

US 2014/0102388 A1 Apr. 17, 2014

(30) Foreign Application Priority Data

Oct. 15, 2012 (JP) ..... 2012-227927

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34463* (2013.01); *F01L 2001/34466* (2013.01); *F01L 2001/34469* (2013.01)

(58) Field of Classification Search
CPC ..... F01L 1/3442; F01L 2001/34453; F01L 2001/34469; F01L 2001/34466
USPC ..... 123/90.15, 90.17
See application file for complete search history.

(56) References Cited

U.S. PATENT DOCUMENTS

| | | | | |
|---|---|---|---|---|
| 6,170,448 | B1 * | 1/2001 | Asakura | 123/90.18 |
| 6,318,319 | B1 * | 11/2001 | Miyasaka et al. | 123/90.17 |
| 8,689,748 | B2 * | 4/2014 | Watanabe | 123/90.17 |
| 2011/0162601 | A1 | 7/2011 | Fujiyoshi et al. | |
| 2012/0318219 | A1 * | 12/2012 | Fischer | 123/90.15 |
| 2013/0068183 | A1 * | 3/2013 | Takada | 123/90.17 |
| 2013/0104822 | A1 * | 5/2013 | Dupuis et al. | 123/90.17 |
| 2013/0112161 | A1 * | 5/2013 | Fujiwaki et al. | 123/90.16 |
| 2013/0180481 | A1 * | 7/2013 | Kato et al. | 123/90.15 |
| 2014/0083379 | A1 * | 3/2014 | Yoshimura et al. | 123/90.15 |

FOREIGN PATENT DOCUMENTS

JP 2010-270746 A 12/2010

* cited by examiner

*Primary Examiner* — Thomas Denion
*Assistant Examiner* — Daniel Bernstein
(74) *Attorney, Agent, or Firm* — Foley & Lardner LLP

(57) ABSTRACT

A valve timing control apparatus includes: a first passage which is formed in the vane rotor, which extends in the radial direction at a position apart from the first lock member and the second lock member in the circumferential direction, which includes an opening portion located in an outer end portion of the first passage, and which receives a hydraulic pressure different from a hydraulic pressure within the advance angle hydraulic chambers and a hydraulic pressure within the retard angle hydraulic chambers; a second passage which is connected to the first passage and hydraulic pressure receiving portions of the first lock member and the second lock member; and a seal member which is press-fit in the opening portion of the outer end portion of the first passage.

17 Claims, 8 Drawing Sheets

VALVE TIMING CONTROL APPARATUS FOR INTERNAL COMBUSTION ENGINE

BACKGROUND OF THE INVENTION

The present invention relates to a valve timing control apparatus for an internal combustion engine which is configured to control an opening and closing timing of an intake valve and an exhaust valve in accordance with a driving state.

There is a valve timing control apparatus of a vane type which is arranged to lock a lock pin for fixing a valve timing, into a lock hole at an intermediate position between a most retard angle and a most advance angle, for improving start-up performance at the start.

In this valve timing control apparatus, when the lock of the lock pin is released, it is preferable to move the lock pin in a rearward direction, not by the hydraulic pressure within the advance angle hydraulic chambers and the retard angle hydraulic chambers, and also without receiving an influence of the hydraulic pressure within the advance angle hydraulic chambers and the retard angle hydraulic chambers.

Accordingly, U.S. Patent Application Publication No. 2011/162601 A1 (corresponding to Japanese Patent Application Publication No. 2010-270746) discloses a valve timing control apparatus arranged to act, through a passage for the lock release only, a hydraulic pressure on an annular end surface which is for receiving the pressure, and which is formed on the outer circumference surface of the lock pin, and thereby to move the lock pin in a rearward direction to release the lock.

The passage for the lock release only is a passage hole which is formed by drilling to penetrate through the vane rotor in the radial direction for the ease of the manufacturing operation. Accordingly, a seal member such as a ball is press-fit in an opening portion of the penetrating passage hole on the outer circumference side to close.

SUMMARY OF THE INVENTION

However, in the above-described valve timing control apparatus, the passage hole for the lock release only is provided near a hole in which the lock pin is slid. Accordingly, when the seal member is press-fit in the opening portion of the passage hole on the outer end side, a portion around the opening portion is plastic-deformed by the press-fit. This plastic-deformation may cause interference with a smooth actuation of the lock pin.

It is, therefore, an object of the present invention to provide a valve timing control apparatus for an internal combustion engine which is devised to solve the above mentioned problem, and to smoothly actuate a lock member even when a passage is closed by press-fitting a seal member.

According to one aspect of the present invention, a valve timing control apparatus for an internal combustion engine comprises: a housing to which a rotational force is transmitted from a crank shaft, and which includes shoes formed on an inner circumference surface of the housing to protrude; a vane rotor which includes a rotor fixed to a cam shaft, and vanes that separate advance angle hydraulic chambers and retard angle hydraulic chambers between the shoes of the housing, and which is arranged to be rotated relative to the housing on one of an advance angle side and a retard angle side by a hydraulic fluid selectively supplied and discharged to and from the advance angle hydraulic chambers and the retard angle hydraulic chambers; a first lock member which is disposed in the vane rotor, which is arranged to be moved toward the housing by an urging force of an urging member, and to be moved in a rearward direction against the urging force of the urging member by receiving a hydraulic pressure; a second lock member which is disposed in the vane rotor, which is arranged to be moved toward the housing by an urging force of an urging member, and to be moved in a rearward direction against the urging force of the urging member by receiving the hydraulic pressure; a first lock recessed portion which is formed in the housing, and which a tip end of the first lock member is arranged to be engageably inserted into, and thereby to restrict the vane rotor at a relative rotational position on the retard angle side relative to a position between a most advance angle position and a most retard angle position; a second lock recessed portion which is formed in the housing, and which a tip end of the second lock member is arranged to be engageably inserted into, and thereby to restrict the vane rotor at a relative rotational position on the advance angle side relative to the position at which the relative rotation on the retard angle side is restricted by the first lock member and the first lock recessed portion; a first passage which is formed in the vane rotor, which extends in the radial direction at a position apart from the first lock member and the second lock member in the circumferential direction, which includes an opening portion located in an outer end portion of the first passage, and which receives a hydraulic pressure different from a hydraulic pressure within the advance angle hydraulic chambers and a hydraulic pressure within the retard angle hydraulic chambers; a second passage which is connected to the first passage and hydraulic pressure receiving portions of the first lock member and the second lock member; and a seal member which is press-fit in the opening portion of the outer end portion of the first passage.

According to another aspect of the invention, a valve timing control apparatus for an internal combustion engine comprises: a housing to which a rotational force is transmitted from a crank shaft, and which includes shoes formed on an inner circumference surface of the housing to protrude; a vane rotor which includes a rotor fixed to a cam shaft, and vanes that separate advance angle hydraulic chambers and retard angle hydraulic chambers between the shoes of the housing, and which is arranged to be rotated relative to the housing on one of an advance angle side and a retard angle side by a hydraulic fluid selectively supplied and discharged to and from the advance angle hydraulic chambers and the retard angle hydraulic chambers; a lock mechanism which is provided to the vane rotor, which is arranged to be abutted on the housing by being urged by an urging member, and thereby to restrict a relative rotational position of the vane rotor relative to the housing, at a position between a most advance angle position and a most retard angle position, and which is arranged to release a lock against the urging force of the urging member by receiving the a hydraulic pressure; a first passage which is formed in the vane rotor, which extends in the radial direction at a position different from positions of the first lock member and the second lock member in the circumferential direction, which includes an opening portion located in a radially outer portion of the first passage, and which receives a hydraulic pressure different from a hydraulic pressure within the advance angle hydraulic chambers and a hydraulic pressure within the retard angle hydraulic chambers; a second passage which is connected to the first passage and hydraulic pressure receiving portions of the first lock member and the second lock member; and a seal member which is press-fit in the opening portion of the radially outer portion of the first passage.

DETAILED DESCRIPTION OF THE INVENTION

Hereinafter, valve timing control apparatuses for an internal combustion engine according to embodiments of the present invention which are applied to an intake valve side are illustrated with reference to the drawings.

First Embodiment

Figure 2:
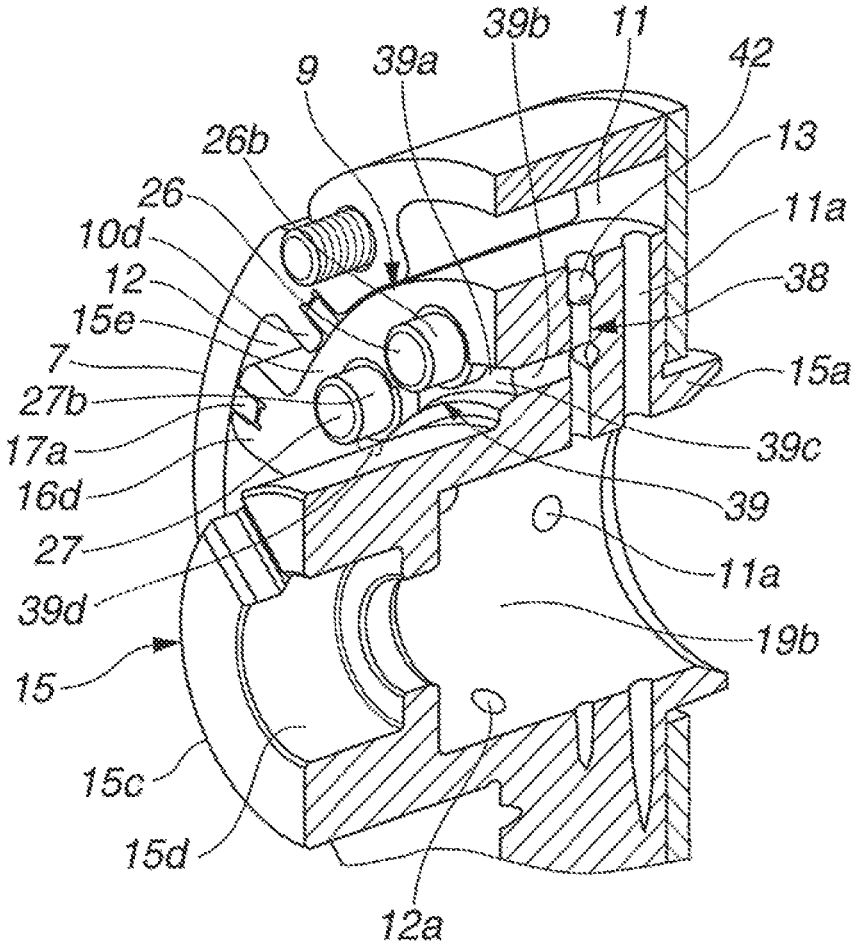
FIG. 2 is a sectional view showing a housing of a vane rotor showing a structure of passages such as a connection passage in the valve timing control apparatus of FIG. 1.
Figure 3:
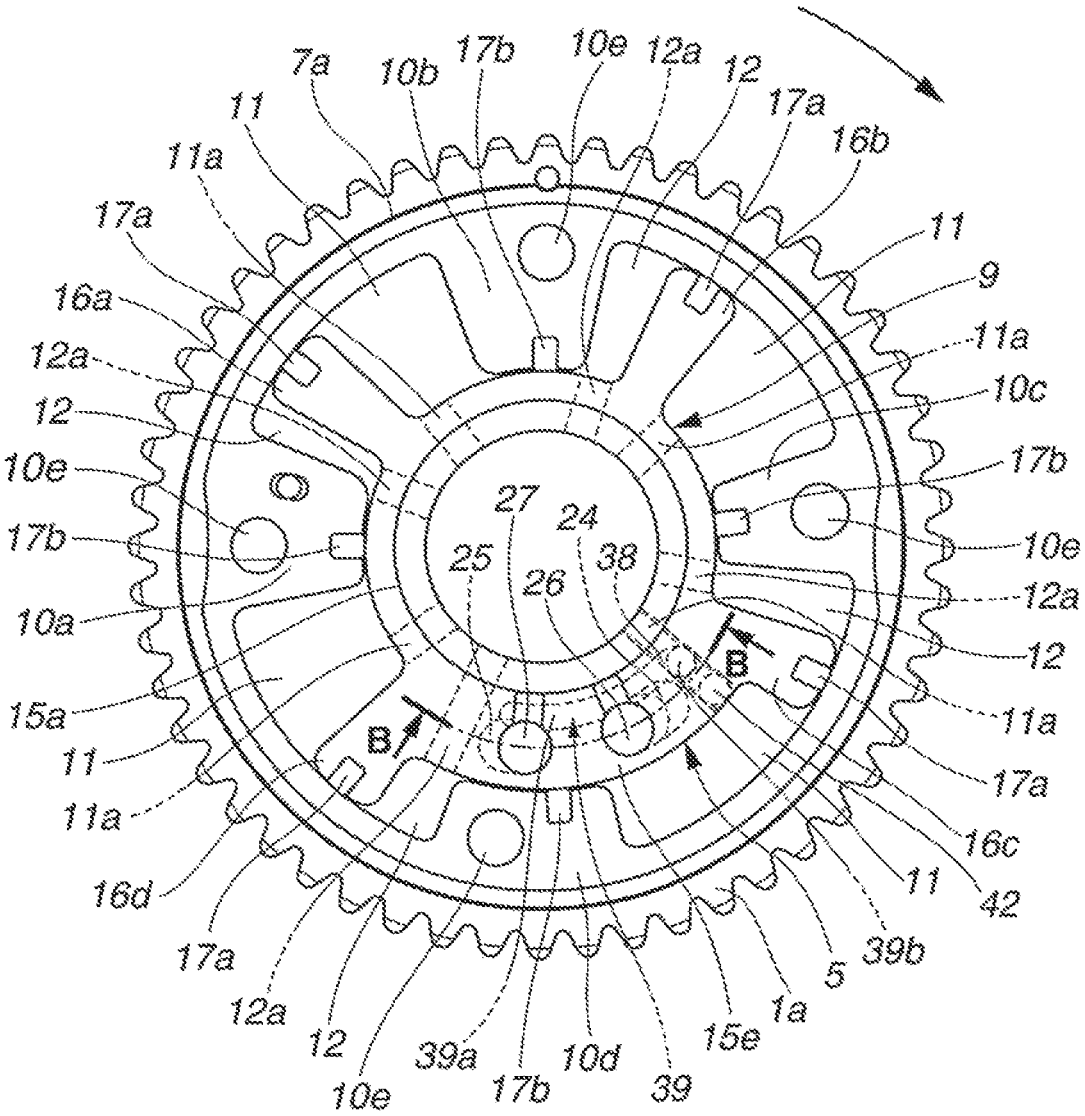
FIG. 3 is a sectional view which is taken along a section line A-A of FIG. 1, and which shows a state where the vane rotor is held at a rotational position of an intermediate phase, in the valve timing control apparatus of FIG. 1.
Figure 4:
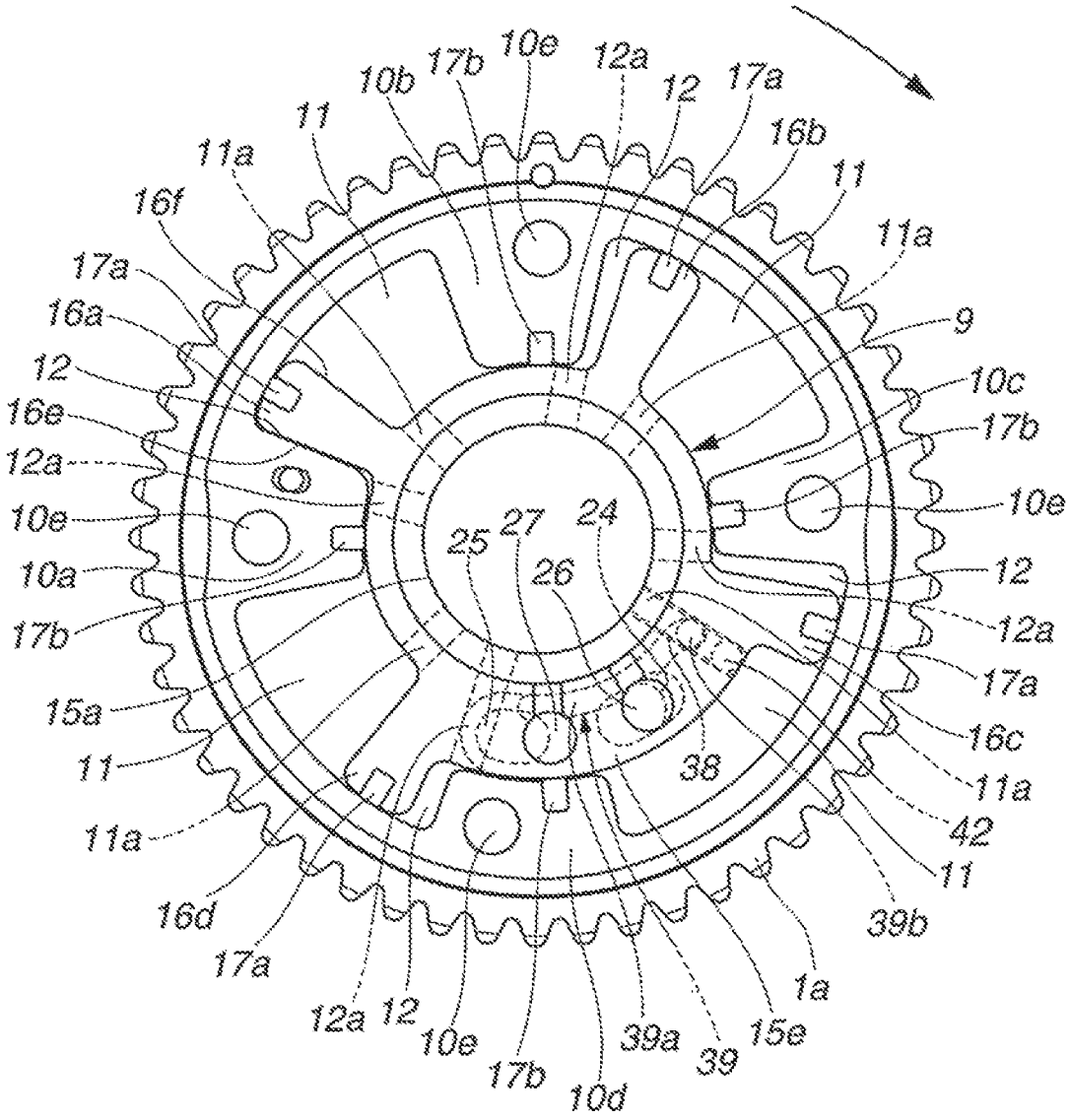
FIG. 4 is a sectional view which is taken along a section line A-A of FIG. 1, and which shows a state where the vane rotor is rotated to a position of a most retard angle phase, in the valve timing control apparatus of FIG. 1.

As shown in FIG. 1 to FIG. 5, this valve timing control apparatus includes a sprocket 1 which is a driving rotational member that is rotationally driven by a crank shaft of the engine through a timing chain; an intake side cam shaft 2 which is disposed in forward and rearward directions of the engine, and which is arranged to be rotated relative to sprocket 1; a phase varying mechanism 3 which is disposed between sprocket 1 and cam shaft 2, and which is arranged to convert a relative rotational phase between sprocket 1 and cam shaft 2; a first hydraulic circuit 4 which is arranged to actuate phase varying mechanism 3; a position holding mechanism 5 which is arranged to hold the relative rotational position of cam shaft 2 relative to sprocket 1, through phase varying mechanism 3, to a predetermined intermediate rotational phase position (a position shown in FIG. 3) between a rotational position of the most retard angle side (a position shown in FIG. 4 and a rotational position of a most advance angle side (a position shown in FIG. 5); and a second hydraulic circuit 6 arranged to actuate position holding mechanism 5.

Sprocket 1 is formed into a circular plate shape having a large thickness. Sprocket 1 includes a large gear portion 1*a* and a small gear portion 1*a*' which are formed on an outer circumference of sprocket 1, and on which a timing chain and an auxiliary machine chain are wound. Sprocket 1 serves as a rear cover closing an opening of a rear end of a housing (described later). Moreover, sprocket 1 includes a support hole 1*b* which is formed at a substantially central portion of sprocket 1 to penetrate through sprocket 1, and which is rotatably supported on an outer circumference of a vane rotor (described later) to which cam shaft 2 is fixed. Moreover, sprocket 1 includes internal screw holes 1*d* which are formed in an outer circumference portion of sprocket 1 at a substantially regular interval in the circumferential direction, and to which four bolts 14 are screwed.

Cam shaft 2 is rotationally supported on a cylinder head (not shown) through cam bearings. Cam shaft 2 includes a plurality of cams which are integrally fixed on an outer circumference surface of cam shaft 2 at predetermined axial positions, and which are arranged to actuate the intake valves; and an internal screw hole 2*a* which is formed within one end portion of cam shaft 2 in the axial direction.

Figure 1:
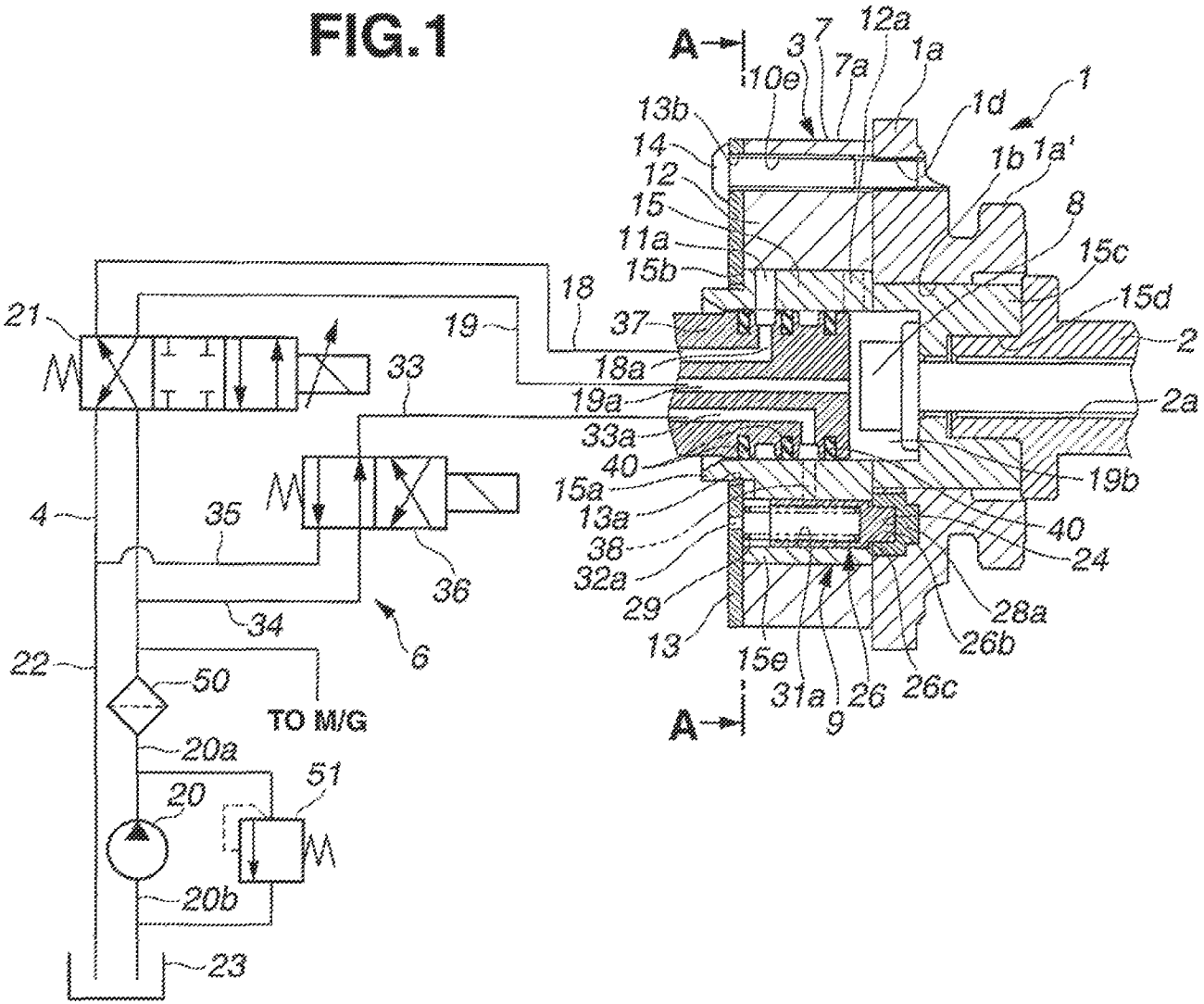
FIG. 1 is an overall structural view showing a valve timing control apparatus according to embodiments of the present invention.

As shown in FIG. 1 and FIG. 3, phase varying mechanism 3 includes a housing 7 which is connected to sprocket 1 in the axial direction, and which includes an operation chamber within housing 7; a vane rotor 9 which is fixed to the one end portion of cam shaft 2 through a cam bolt 8 screwed in internal screw hole 2*a*, and which is a driven rotational member received within housing 7 to be relatively rotated; and four retard angle hydraulic chambers 11 and four advance angle hydraulic chambers 12 which are formed by separating the operation chamber of housing 7 by four first to fourth shoes 10*a*-10*d* which are formed on an inner circumference surface of housing 7, and vane rotor 9.

Housing 7 includes a housing main body 7*a* which is formed from a sintered metal into a cylindrical shape; a front cover 13 which is formed by a press forming, and which closes an opening of a front end of housing 7; and sprocket 1 which serves as the rear cover closing the opening of the rear end of housing 7. Housing main body 7*a*, front cover 13, and sprocket 1 are fixed by screwing together by four bolts 14 penetrating through holt insertion holes 10*e* of shoes 10 and so on. Front cover 13 includes an insertion hole 13*a* formed at a substantially central portion of front cover 13 to penetrate through front cover 13; and four bolt insertion holes 13*b* which are formed in an outer circumference portion of front cover 13 in the circumferential direction.

Vane rotor 9 is formed into an integral shape from metal material. Vane rotor 9 includes a rotor 15 which is fixed to the one end portion of cam shaft 2 by cam bolt 8; and four first to fourth vanes 16*a*-16*d* which are provided on the outer circumference surface of rotor 15 at a regular interval of 90 degrees in the circumferential direction, and which protrude in the radial directions.

As shown in FIG. 2, rotor 15 is formed into a long substantially cylindrical elongated shape extending in the forward and rearward directions. Rotor 15 includes an insertion guide portion 15*a* which is formed into a cylindrical shape having a small thickness, and which is integrally formed at a substantially central position of a front end surface 15*b* of rotor 15; and a rear end portion 15*c* extending toward cam shaft 2. Moreover, rotor 15 includes a cylindrical mounting groove 15*d* which is formed inside rear end portion 15*c* of rotor 15.

Figure 5:
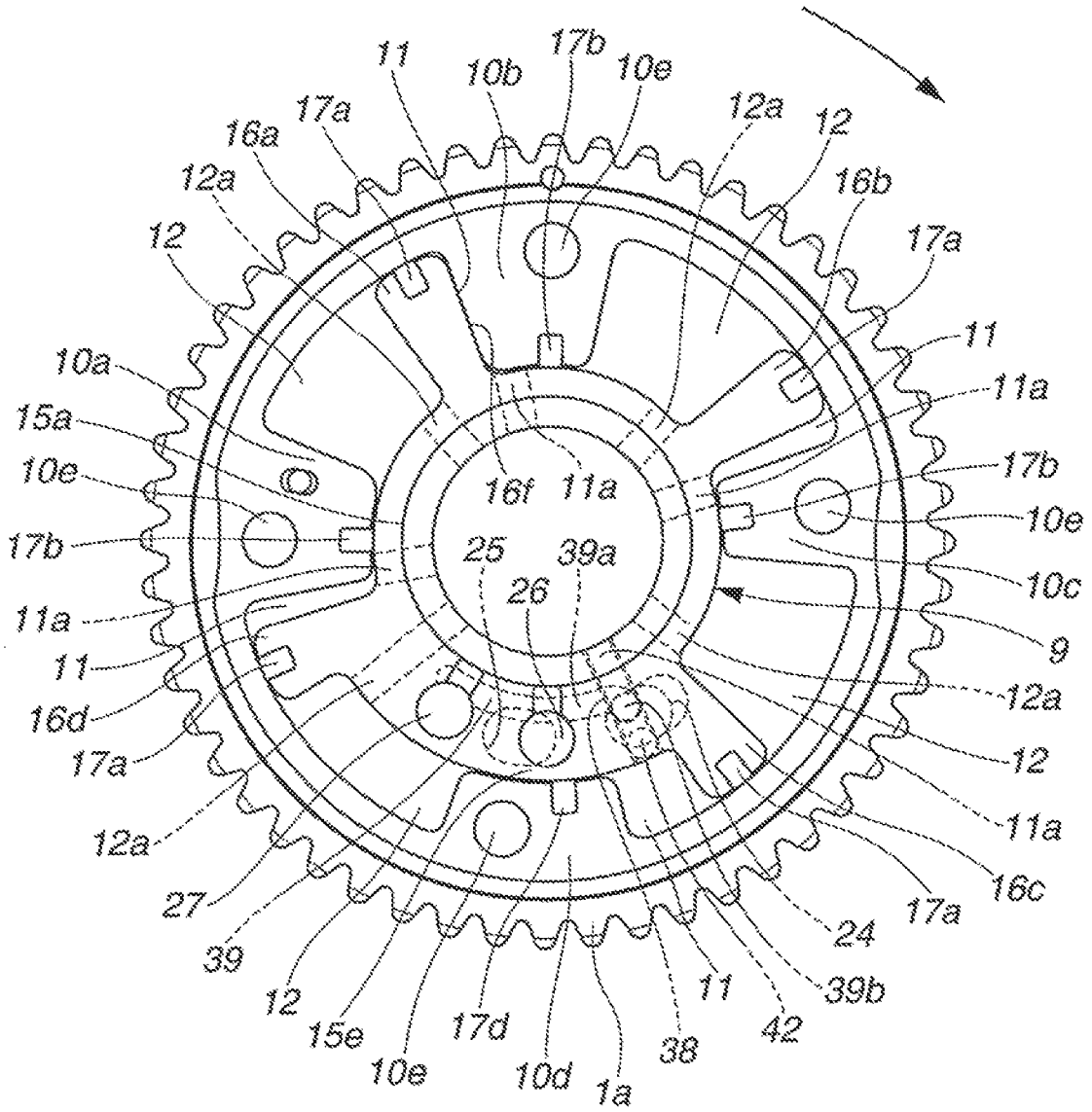
FIG. 5 is a sectional view taken along a section line A-A of FIG. 1, and which shows a state where the vane rotor is rotated to a position of a most advance angle phase, in the valve timing control apparatus of FIG. 1.

On the other hand, as shown in FIG. 3 to FIG. 5, first to fourth vanes 16*a*-16*d* are disposed, respectively, between corresponding adjacent two of shoes 10*a*-10*d*. First to fourth vanes 16*a*-16*d* have the same width in the circumferential direction. Each of first to fourth vanes 16*a*-16*d* includes a seal groove which is formed in an arc outer circumference surface of the each of first to fourth vanes 16*a*-16*d*. A seal member 17*a* is mounted in the seal groove of each of first to fourth vanes 16*a*-16*d*. Seal members 17*a* are arranged to be slid on an inner circumference surface of housing main body 7*a* to seal. On the other hand, each of shoes 10*a*-10*d* includes a seal groove formed in an inner circumference surface of a tip end portion of the each of shoes 10*a*-10*d*. A seal member 17*b* is mounted in the seal groove of the each of shoes 10*a*-10*d*. Seal members 17*b* are arranged to be slid on an outer circumference surface of rotor 15 to seal.

Moreover, when vane rotor 9 is relatively rotated on the most retard angle side as shown in FIG. 4, a first side surface 16*e* of first vane 16*a* is abutted on a confronting side surface of first shoe 10*a* which confronts first side surface 16*e* of first vane 16*a* in the circumferential direction, so as to restrict the rotational position on the most retard angle side. Furthermore, when vane rotor 9 is relatively rotated on the most advance angle side as shown in FIG. 5, a second side surface 16*f* of first vane 16*a* is abutted on a confronting side surface of second shoe 10*b* which confronts second side surface 16*f* of first vane 16*a* in the circumferential direction, so as to restrict the rotational position on the most advance angle side. These first vane 16*a* and first and second shoes 10*a* and 10*b* serve as a stopper section to restrict the most retard angle position and the most advance angle position of vane rotor 9.

In this case, other second to fourth vanes 16*b*-16*d* are not abutted on the confronting side surfaces of shoes 10*a*, 10*b*, 10*c* and 10*d* which confront the both side surfaces of second to fourth vanes 16*b*-16*d* in the circumferential direction, that is, other second to fourth vanes 16*b*-16*d* are separated from the confronting side surfaces of shoes 10*a*, 10*b*, 10*c* and 10*d*. Accordingly, it is possible to improve the accuracy of the abutments between vane rotor 9 and shoes 10*a*-10*d*. Moreover, the speed of the supply of the hydraulic pressure to hydraulic chambers 11 and 12 (described later) becomes higher. Consequently, it is possible to increase the response of the rotation of vane rotor 9 in the positive direction and in the reverse direction.

Moreover, rotor 15 includes a large diameter portion 15*e* which is integrally formed between third vane 16*c* and fourth vane 16*d*. This large diameter portion 15*e* is formed to connect the confronting surfaces of both vanes 16*c* and 16*d*. Large diameter portion 15*e* is formed into an arc shape which is formed around a shaft center of rotor 15. Moreover, large diameter portion 15*e* has a uniform radial width which extends to a substantially central position of retard angle hydraulic chambers 11 and advance angle hydraulic chambers 12 (described later) in the radial direction.

Between the both side surfaces of first to fourth vanes 16*a*-16*d* in the positive direction and in the reverse direction, and the both side surfaces of first to fourth shoes 10*a*-10*d*, there are separated, respectively, four retard angle hydraulic chambers 11 and four advance angle hydraulic chambers 12. Each of retard angle hydraulic chambers 11 is connected to first hydraulic circuit 4 through a first connection hole 11*a* formed in rotor 15 to extend in the radial direction. Each of advance angle hydraulic chambers 12 is connected to first hydraulic circuit 4 through a second connection hole 12*a* formed in rotor 15 to extend in the radial direction.

First hydraulic circuit 4 is arranged to selectively supply and discharge the hydraulic fluid (the hydraulic pressure) to and from retard angle hydraulic chambers 11 and advance angle hydraulic chambers 12. As shown in FIG. 1, first hydraulic circuit 4 includes a retard angle hydraulic passage 18 which is arranged to supply and discharge the hydraulic pressure to and from retard angle hydraulic chambers 11 through first connection holes 11*a*; an advance angle hydraulic passage 19 which is arranged to supply and discharge the hydraulic pressure to and from advance angle hydraulic chambers 12 through second connection holes 12*a*; an oil pump 20 which is a hydraulic pressure supply source arranged to supply the hydraulic fluid to retard angle hydraulic passage 18 and advance angle hydraulic passage 19; and a first electromagnetic switching valve 21 which is arranged to switch fluid passages of retard angle hydraulic passage 18 and advance angle hydraulic passage 19 in accordance with an operation state of the engine. Oil pump 20 is a general pump such as a trochoid pump rotationally driven by the crank shaft of the engine.

Retard angle hydraulic passage 18 and advance angle hydraulic passage 19 include, respectively, first end portions connected with passage ports of first electromagnetic switching valve 21. On the other hand, retard angle hydraulic passage 18 includes a second end portion which includes a retard angle passage portion 18*a* which is formed into an L-shape in a substantially cylindrical passage forming section 37 that is inserted and held in insertion guide portion 15*a*. Advance angle hydraulic passage 19 includes a second end portion which includes an advance angle passage portion 19*a* which is formed inside passage forming portion 37 into a linear shape in the axial direction. Retard angle passage portion 18*a* is connected through first connection holes 11*a* to retard angle hydraulic chambers 11. Advance angle passage portion 19*a* is connected to advance angle hydraulic chambers 12 through a hydraulic chamber 19*b* formed on a head portion side of cam bolt 8, and second connection holes 12*a*.

Passage forming section 37 includes an outside end portion which is fixed to a chain cover (not shown) to serve as a rotated portion. In addition to passage portions 18*a* and 19*a*, passage forming section 37 includes passages of second hydraulic circuit 6 which is formed inside passage forming section 37 in the axial direction. Second hydraulic circuit 6 is arranged to release a lock of a lock mechanism (described later).

As shown in FIG. 1, first electromagnetic switching valve 27 is a four-port and three-position proportional type valve which has four ports and three positions. An electronic controller (not shown) moves a spool valve element (not shown) provided within a valve body to be slid in the axial direction, in forward and rearward directions, so that first electromagnetic switching valve 21 connects a discharge passage 20*a* of oil pump 20 and one of retard angle hydraulic passage 18 and advance angle hydraulic passage 19, and simultaneously connects the other of the retard angle hydraulic passage 18 and advance angle hydraulic passage 19, and a drain passage 22.

A suction passage 20*b* of oil pump 20 and drain passage 22 are connected to an oil pan 23. Moreover, there is provided a filter 50 positioned on a downstream side of discharge passage 20*a* of oil pump 20. Discharge passage 20*a* of oil pump 20 is connected on a downstream side of filter 50 to a main oil gallery M/G arranged to supply the lubricating oil to sliding portions of the internal combustion engine. Moreover, oil pump 20 is provided with a flow rate regulating valve 51 arranged to control to an appropriate flow rate by discharging an excessive hydraulic fluid discharged from discharge passage 20*a*, to oil pan 23.

The electronic controller includes an internal computer which receives information signals from various sensors such as a crank angle sensor (not shown), an air flow meter (not shown), an engine water temperature sensor (not shown), an engine temperature sensor (not shown), a throttle valve opening degree sensor (not shown), and a cam angle sensor (not shown) arranged to sense a current rotational phase of cam shaft 2, and thereby senses a current engine driving state. Moreover, the electronic controller is configured to output a control pulse current to electromagnetic coils of first electromagnetic switching valve 21 and a second electromagnetic switching valve 36 (described later) so as to control movement positions of the spool valve elements of first electromagnetic switching valve 21 and second electromagnetic switching valve 36. With this, the electronic controller controls to switch the passages.

Moreover, the valve timing control apparatus according to this embodiment includes position holding mechanism 5 which is arranged to hold vane rotor 9 with respect to housing 7, to the intermediate rotational phase position (the position shown in FIG. 3) between the rotational position (the position shown in FIG. 4) on the most retard angle side (the position shown in FIG. 5) on the most advance angle side.

As shown in FIGS. 1-6, this position holding mechanism 5 includes two first and second lock hole forming members 28*a* and 28*b* which are formed into cylindrical shapes, and which are provided on an inner side surface 1*c* of sprocket 1 at positions corresponding to large diameter portion 15*e* of rotor 15 in the circumferential direction; first and second lock holes 24 and 25 which are lock recessed portions formed in lock hole forming members 28*a* and 28*b*; first and second lock pins 26 and 27 which are provided within large diameter portion 15*e* of rotor 15 of vane rotor 9, and which are two lock members arranged to be engaged with and disengaged from lock holes 24 and 25; and second hydraulic circuit 6 (cf. FIG. 1) which is arranged to release the engagements of lock pins 26 and 27 with lock holes 24 and 25.

As shown in FIGS. 3-6, first lock hole 24 is formed on an upper surface side of first lock hole forming member 28*a* into an elongated groove shape extending in the circumferential direction. First lock hole 24 includes a bottom surface having a two stepped shape whose heights are lowered from the retard angle side to the advance angle side. The bottom surface of first lock hole 24 includes an uppermost stage which is inner side surface 1*c* of sprocket 1; a first bottom surface 24*a* which is lower than inner side surface 1*c* of sprocket 1 by one stage; and a second bottom surface 24*b* which is lower than first bottom surface 24*a* by one stage. In this way, the bottom surface of first lock hole 24 is formed into a stepwise (stair-like) shape which becomes lower in order. First lock hole 24 includes an inner side surface 24*d* which is located on the retard angle side, and which is a wall surface standing up in the vertical direction. Moreover, first lock hole 24 includes an inner side edge 24*c* which is connected to second bottom surface 24*b*, which is located on the advance angle side, and which is a wall surface standing up in the vertical direction. First bottom surface 24*a* has an area set smaller than an area of a tip end surface of first lock pin 26. On the other hand, second bottom surface 24*b* slightly extends in the circumferential direction (in the advance angle direction). With this, second bottom surface 24*b* has an area set larger than the tip end surface of first lock pin 26. This second bottom surface 24*b* is positioned on inner side surface 1*c* of sprocket 1 at an intermediate position which is slightly apart from the most retard angle position of vane rotor 9 in the advance angle direction.

Second lock hole 25 is formed on the upper surface side of second lock hole forming member 28*b* on a concentric circle on which first lock hole 24 is located. Second lock hole 25 is formed into a circular shape. Moreover, second lock hole 25 includes a bottom surface 25*a* which does not have a stepped shape, which is formed into a flat overall shape, and which is provided on inner side surface 1*c* of sprocket 1 at an intermediate position which is slightly apart from the most advance angle position of vane rotor 9 in the retard angle direction. Moreover, second lock hole 25 includes an inner side surface which is on the advance angle side, and which is a wall surface standing up in the vertical direction, and an inner side surface 25*b* which is located on the retard angle side, and which is a wall surface standing up in the vertical direction.

Moreover, first lock hole 24 and second lock hole 25 are constituted as release pressure receiving chambers into which the hydraulic pressures are introduced from second hydraulic circuit 6. The hydraulic pressures introduced into first lock hole 24 and second lock hole 25 are simultaneously acted to tip end surfaces of first and second lock pins 26 and 27, and first and second stepped surfaces 26*c* and 27*c* (pressure receiving surfaces) (described later) of first and second lock pins 26 and 27.

Figure 6:
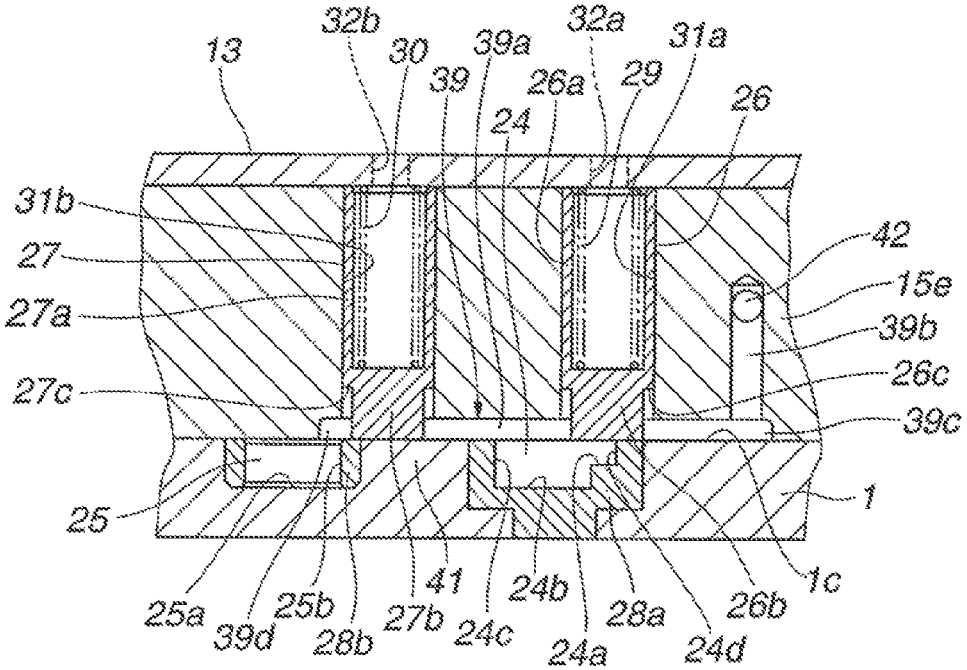
FIG. 6 is a sectional view which is taken along a section line B-B of FIG. 3, and which shows operations of lock pins when the vane rotor is positioned on the most retarded angle side.

As shown in FIG. 5 and FIG. 6, first lock pin 26 includes a pin main body 26*a* which is slidably disposed within a first pin hole 31*a* formed in large diameter portion 15*e* of rotor 15 to penetrate through in the axial direction; and a tip end portion 26*b* which has a small diameter, and which is integrally provided on a tip end side of pin main body 26*a* through a first stepped surface 26*c*.

Pin main body 26*a* includes an outer circumference surface which is a simple straight cylindrical surface. Pin main body 26*a* is arranged to be liquid-tightly slid in first pin hole 31*a*. On the other hand, tip end portion 26*b* has a substantially solid cylindrical shape having a small diameter. Tip end portion 26*b* has an outside diameter smaller than an inside diameter of first lock hole 24.

First lock pin 26 is urged in a direction in which first lock pin 26 is engaged with first lock hole 24, by a spring force of a first spring 29 which is an urging member elastically mounted between a bottom surface of a recessed groove formed inside first lock pin 26 from the rear end side in the axial direction, and an inner surface of front cover 13.

First stepped surface 28*c* is formed into an annular shape. First stepped surface 26*c* serves as a pressure receiving surface which receives the hydraulic pressure introduced from a connection passage 39 (described later), so as to move first lock pin 26 in the rearward direction from first lock hole 24 against the spring force of first spring 29 to release the lock.

Moreover, front cover 13 includes a first breath hole 32*a* which is formed on the upper end side of first pin hole 31*a*, which penetrates through front cover 13, and which is arranged to be connected to atmosphere, and thereby to ensure a smooth sliding movement of first lock pin 26.

Moreover, when vane rotor 9 is rotated from the most retard angle position toward the most advance angle side, tip end portion 26*b* of first lock pin 26 is stepwisely engaged with bottom surfaces 24*a* and 24*b* of first lock hole 24 as shown in FIG. 6 to FIG. 9. Then, tip end portion 26*b* of first lock pin 28 is abutted and slid on second bottom surface 24*b*, and a further rotation of vane rotor 9 on the advance angle direction is finally restricted when a side edge of tip end portion 26*b* is abutted on inner side edge 24*c* on the advance angle side. Concrete illustrations are described later.

Second lock pin 27 has an outside diameter and a length which are substantially identical to those of first lock pin 26. Second lock pin 27 includes a pin main body 27*a* which is slidably disposed within a second pin hole 31*b* that is formed inside large diameter portion 15*e* of rotor 15 at an adjacent position of first pin hole 31*a* in the circumferential direction to penetrate through in the axial direction; and a tip end portion 27*b* which has a small diameter, and which is integrally formed on a tip end side of pin main body 27*a* through a second stepped surface 27*c*.

Pin main body 27*a* has an outer circumference surface which has a simple straight cylindrical surface. Pin main body 27*a* is arranged to be liquid-tightly slid in second pin hole 31*b*. On the other hand, tip end portion 27*b* has a substantially solid cylindrical shape having a small diameter. Tip end portion 27*b* has an outside diameter smaller than an inside diameter of second lock hole 25.

This second lock pin 27 is urged in a direction in which second lock pin 27 is engageably inserted in second lock hole 25, by a spring force of a second spring 30 which is an urging member elastically mounted between a bottom surface of a recessed groove formed inside second lock pin 27 from the rear end side in the axial direction, and the inner surface of front cover 13.

Second stepped surface 27*c* is formed into an annular shape. Second stepped surface 27*c* serves as a pressure receiving surface which receives the hydraulic pressure introduced from connection passage 39 (described later), so as to move second lock pin 27 in the rearward direction from second lock hole 25 against the spring force of second spring 30, and thereby to release the lock.

Front cover 13 includes a second breath hole 32*b* which is formed on the upper end side of second pin hole 31*b*, which penetrates through front cover 13, and which is arranged to be connected to the atmosphere, and thereby to ensure a smooth sliding movement of second lock pin 27.

Moreover, when vane rotor 9 is rotated from the most retard angle position toward the most advance angle position, tip end portion 27*b* of second lock pin 27 is slid on inner side surface 1*c* of sprocket 1 as shown in FIG. 6 to FIG. 9. Then, tip end portion 27*b* is engaged with second lock hole 25, and a tip end surface of tip end portion 27*b* is elastically abutted on bottom surface 25*a*. At this time, a further rotation of vane rotor 9 in the retard angle direction is restricted when a side edge of tip end portion 27*b* is abutted on inner side edge 25*b* on the retard angle side.

Figure 9:
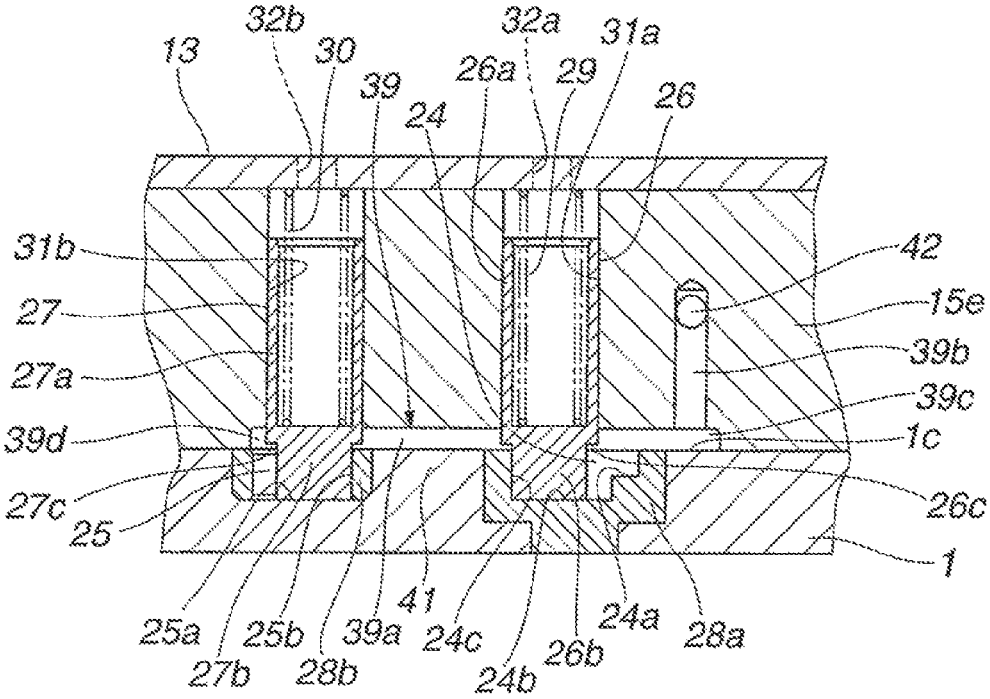
FIG. 9 is a sectional view which is taken along a section line B-B of FIG. 3, and which shows operations of the lock pin when the vane rotor is further rotated on the advance angle side from the position shown in FIG. 8 to the intermediate position.
Figure 10:
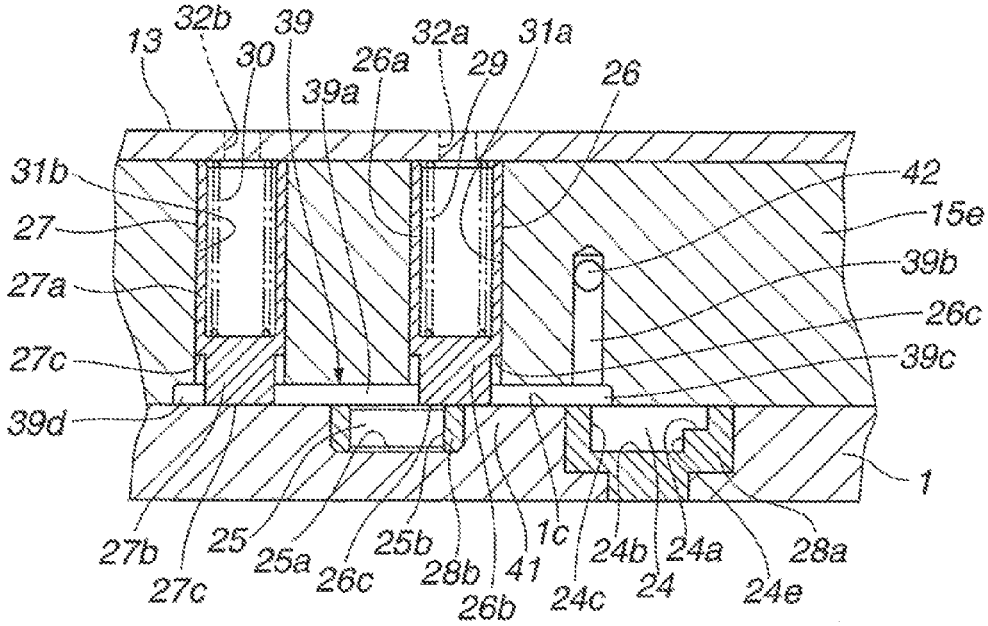
FIG. 10 is a sectional view showing an operation of operations of the lock pins when the vane rotor is positioned on the most advance angle side.

As shown in FIG. 9, first lock pin 26 is also engaged with first lock hole 24 at the engagement position of second lock pin 27, so that the side edge of tip end portion 26*b* is abutted on inner side edge 24*c* on the second bottom surface 24*b*'s side. Accordingly, first lock pin 26 and second lock pin 27 sandwich a separation wall portion 41 between both pin holes 24 and 25, so as to restrict a free rotation of vane rotor 9 to the advance angle side and the retard angle side.

That is, first and second lock pins 26 and 27 are concurrently engaged, respectively, with the corresponding first and second lock holes 24 and 25. With this, vane rotor 9 is held with respect to housing 7 at the intermediate phase position between the most retard angle phase and the most advance angle phase.

Besides, first and second stepped surfaces 26*c* and 27*c* are formed to be positioned slightly above the edges of the upper ends of lock holes 24 and 25 in a state where both lock pins 26 and 27 are engaged with lock holes 24 and 25, as shown in FIG. 9.

As shown in FIG. 1, second hydraulic circuit 6 includes a supply and discharge passage portion 33 arranged to supply the hydraulic pressure to first and second lock holes 24 and 25 through a supply passage 34 bifurcated from discharge passage 20*a* of oil pump 20, and to discharge the hydraulic fluid within first and second lock holes 24 and 25 through a discharge passage 35 connected to drain passage 22; and second electromagnetic switching valve 36 which is a second control valve arranged to selectively switch supply and discharge passage 33, and supply passage 34 and discharge passage 35 in accordance with the state of the engine.

As shown in FIG. 1 and FIG. 2, supply and discharge passage 33 includes one end portion connected to a corresponding passage port of second electromagnetic switching valve 36, and a supply and discharge passage portion 33*a* which is the other end side, which is formed in an inside of passage forming section 37 to be bent from the axial direction in the radial direction, and which is connected to lock holes 24 and 25 through a radial passage 38 which is a first passage formed inside rotor 15, and connection passage 39 which is a second passage formed inside rotor 15.

Passage forming section 37 includes a plurality of mounting grooves which have annular shapes, and which are formed on the outer circumference surface at front and rear positions in the axial direction. Moreover, three seal rings 40 are mounted and fixed, in the mounting grooves of passage forming section 37. Three seal rings 40 are arranged to seal the opening ends of retard angle passage portion 18*a* and supply and discharge passage portion 33*a*, and the one end side of hydraulic chamber 19*b*.

As shown in FIG. 2, FIG. 3, and FIG. 6, radial passage 38 is formed by drilling along the radial direction of rotor 15 from a position which is at an intermediate position circumferentially between a side surface of third vane 16*c* on the advance angle side, and first pin hole 31*a*, and which is an intermediate position of vane rotor 9 in the axial direction, so as to penetrate through vane rotor 9. That is, radial passage 38 is formed at a position apart from first pin hole 31*a* in the circumferential direction.

A ball plug member 42 which is a seal member (closing member) is press-fitted in an end portion of the opening of radial passage 38 on the radially outer side. This ball plug member 42 is provided to liquid-tightly seal the end portion of the opening of radial passage 38 on the radially outer side.

As shown in FIG. 2 and FIG. 3, connection passage 39 includes a groove passage 39*a* which has a substantially arc shape, and which is formed by cutting on a rear end surface of rotor 15; and an axial passage 39*b* which is formed in the axial direction from radial passage 38, and which is connected to a substantially central position of radial passage 38. Groove passage 39*a* is formed at a position which is sufficiently closer to an inner circumference surface of large diameter portion 15*e* of rotor 15, that is, groove passage 39*a* is formed at a position which is offset from the centers of lock holes 24 and 25 in the radially inward direction (toward the center of rotor 15).

Moreover, connection passage 39 is formed to have a circumferential length set so as to confront first lock hole 24 and second lock hole 25 in a range from first end portion 39*c* on the first pin hole 31*a*'s side to second end portion 39*d* on the second pin hole 31*b*'s side at any relative rotational position of vane rotor 9. With this, connection passage 39 is constantly connected to first lock hole 24 and second lock hole 25. Moreover, connection passage 39 confronts tip end portions of first and second pin holes 31*a* and 31*b*. That is, as shown in FIG. 6 to FIG. 10, connection passage 39 is formed to be constantly connected to first and second stepped surfaces 26*c* and 27*c* and first and second lock holes 24 and 25 at any rotational positions of vane rotor 9 from the rotational position (FIG. 6) on the most retard angle side to the rotational position (FIG. 10) on the most advance angle side. Moreover, tip end portion 39*c* of connection passage 39 is connected to axial passage 39*b*.

Second electromagnetic switching valve 36 is a three-port and two-position ON-OFF valve which has three ports and two positions. Second electromagnetic switching valve 36 is arranged to selectively connect supply and discharge passage 33 and one of passages 34 and 35 by a spool valve element by an ON-OFF control current outputted from the electronic controller, and a spring force of a valve spring inside electromagnetic switching valve 36.

Functions and Effects of First Embodiment

Hereinafter, functions and effects of the valve timing control apparatus according to the first embodiment of the present invention is illustrated.

When the engine is stopped by the OFF operation of the ignition switch, the electronic controller outputs the control current to first electromagnetic switching valve 21 immediately before the engine is completely stopped. With this, the spool valve element is moved in one direction of the axial direction so as to connect discharge passage 20*a* and one of retard angle hydraulic passage 18 and advance angle passage 19, and to connect drain passage 22 and the other of retard angle hydraulic passage 18 and advance angle passage 19. That is, the electronic controller senses a current relative rotational position of vane rotor 9 based on the information signals from the cam angle sensor and the crank angle sensor. Based on this, the hydraulic pressure is supplied to retard angle hydraulic chambers 11 and advance angle hydraulic chambers 12. With this, as shown in FIG. 3, vane rotor 9 is controlled to be rotated to a predetermined intermediate position between the most retard angel side and the most advance angle side.

At the same time, second electromagnetic switching valve 36 is energized so as to connect supply and discharge passage 33 and discharge passage 35. With this, the hydraulic fluids within first and second lock holes 24 and 25 flow from connection passage 39 and radial passage 38 through supply and discharge passage 33 into discharge passage 35 and drain passage 22, and is discharged into oil pan 23, so that first and second lock holes 24 and 25 become the low pressure state. With this, as shown in FIG. 9, lock pins 26 and 27 are urged in forward directions (in a direction in which lock pins 26 and 27 are engaged with lock holes 24 and 25) by the spring forces of springs 29 and 30. Consequently, lock pins 26 and 27 are engaged, respectively, with lock holes 24 and 25.

In this state, an outer side surface of tip end portion 26*b* of first lock pin 26 is abutted on confronting inner side surface 24*c* of first lock hole 24 on the advance angle side so as to restrict the movement in the advance angle direction. On the other hand, an outer side surface of tip end portion 27*b* of second lock pin 27 is abutted on confronting inner side surface 25*b* of second lock hole 25 on the retard angle side so as to restrict the movement in the retard angle direction.

By this operation, vane rotor 9 is held at the intermediate phase position, as shown in FIG. 3. The closing timing of the intake valve is controlled on the advance angle side relative to a piston bottom dead center.

Accordingly, in a case where the engine is restarted in an engine cold state in which a sufficient time period is elapsed from the stop of the engine, it is possible to increase an effective compression ratio of the engine by a peculiar closing timing of the intake valve, and thereby to improve the combustion. Consequently, it is possible to improve the start-up performance.

Then, when the engine is shifted to the idling operation, first electromagnetic switching valve 21 connects discharge passage 20*a* and retard angle hydraulic passage 18, and connects advance angle hydraulic chambers 19 and drain passage 22 by the control current outputted from the electronic controller. On the other hand, at this time, the electronic controller does not energize second electromagnetic switching valve 36, so as to connect supply and discharge passage 33 and supply passage 34, and to close discharge passage 25.

Accordingly, the hydraulic pressure discharged from oil pump 20 to discharge passage 20*a* flows through supply passage 34, supply and discharge passage 33, and radial passage 38 into connection passage 39. Then, this hydraulic pressure flows into lock holes 24 and 25, and this hydraulic pressure is acted to first and second stepped surfaces 26*c* and 27*c* of lock pins 26 and 27 which are the pressure receiving surfaces. Accordingly, lock pins 26 and 27 are moved in the rearward directions against the spring forces of springs 29 and 30. Tip end portions 26*b* and 27*b* of lock pins 26 and 27 are moved out of lock holes 24 and 25 to release the lock. With this, vane rotor 9 is allowed to be freely rotated.

Moreover, a part of the hydraulic pressure discharged to discharge passage 20*a* is supplied through retard angle passage 18 and first connection holes 11*a* to retard angle hydraulic chambers 11. On the other hand, the hydraulic fluids within advance angle hydraulic chambers 12 are discharged through second connection holes 12*a* and advance angle passage 19 from drain passage 22 to oil pan 23.

Accordingly, retard angle hydraulic chambers 11 become the high pressure. On the other hand, advance angel hydraulic chambers 12 become the low pressure. Consequently, as shown in FIG. 4, vane rotor 9 is rotated on left side of the drawing (on the retard angle side), so that first side surface 16*e* of first vane 16*a* is abutted on the confronting side surface of first shoe 10*a*, so that vane rotor 9 is restricted and held at the rotational position on the most retard angle side.

Accordingly, there is no valve overlap between the intake valve and the exhaust valve. Consequently, the blow back of the combustion gas is suppressed. Therefore, it is possible to obtain a good combustion state, and to improve the fuel economy and to stabilize the rotation of the engine.

Moreover, for example, when the engine becomes the high engine speed region, first electromagnetic switching valve 21 switches the flow passages by the control current outputted from the electronic controller, as shown in FIG. 1, so as to connect discharge passage 20*a* and advance angle hydraulic passage 19, and to connect retard angle hydraulic chambers 18 and drain passage 22. On the other hand, at this time, second electromagnetic switching valve 36 continues to connect supply and discharge passage 33 and supply passage 34, and to close discharge passage 35.

Accordingly, in this case, advance angle hydraulic chambers 12 become the high pressure, and retard angle hydraulic chambers 11 become the low pressure. Consequently, as shown in FIG. 5, vane rotor 9 is rotated on the advance angle side, so that second side surface 16*f* of first vane 16*a* is abutted on the confronting side surface of second shoe 10*b*. Therefore, vane rotor 9 is held at the rotational position on the most retard angle side. With this, the opening timing of the intake valve is advanced. The valve overlap with the exhaust valve becomes large. Consequently, the intake air volume is increased so that the output is improved.

When the ignition switch is operated to the OFF state so as to stop the engine as described above, in a case where vane rotor 9 is not returned to the intermediate position between the most retard angle side and the most advance angle side which is appropriate for the engine restart due to some causes and vane rotor 9 is stopped, for example, at the position on the most retard angle side as shown in FIG. 4 and FIG. 6, the following operation is performed at the restart of the engine.

Figure 7:
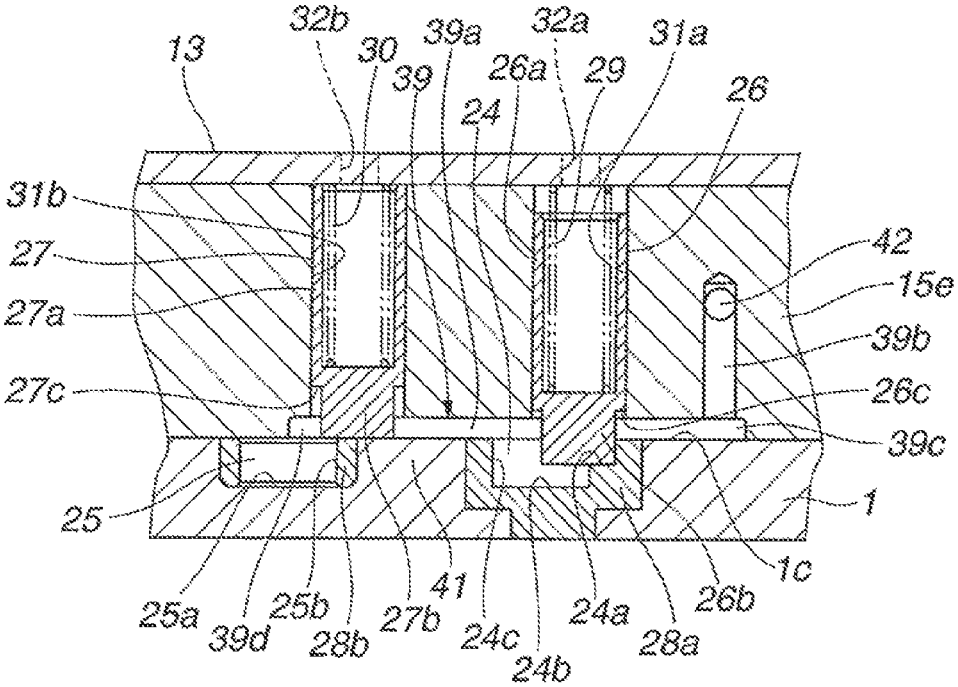
FIG. 7 is a sectional view which is taken along a section line B-B of FIG. 3, and which shows operations of the lock pins when the vane rotor is slightly rotated on the advance angle side from the most retarded angle position.

That is, when the cranking is started by the ON operation of the ignition switch, at the initial stage of the cranking, cam shaft 2 (vane rotor 9) receives the positive and negative alternating torque generated due to the spring force of the valve spring. When the negative torque of this variation torque is inputted, vane rotor 9 is slightly rotated on the advance angle side. Accordingly, tip end portion 26*b* of first lock pin 26 is moved in the downward direction by the spring force of first spring 29, and abutted on first bottom surface 24*a* of first lock hole 24, as shown in FIG. 7.

Figure 8:
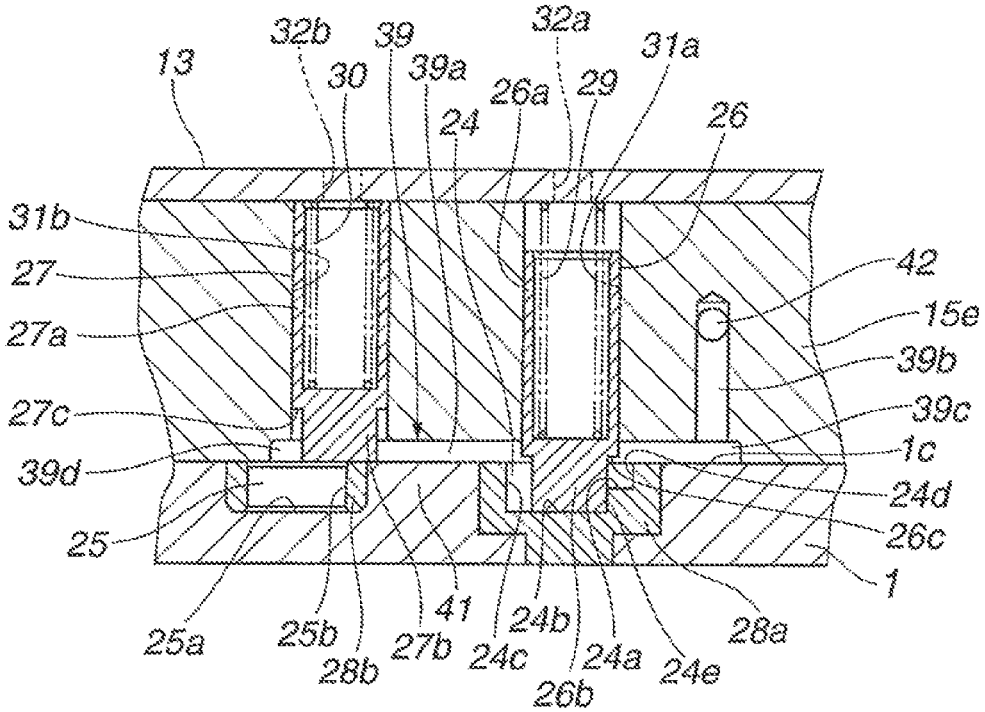
FIG. 8 is a sectional view which is taken along a section line B-B of FIG. 3, and which shows operations of the lock pins when the vane rotor is further rotated on the advance angle side from the position shown in FIG. 7.

Immediately after this, when the positive torque is inputted to vane rotor 9 and the rotational force in the retard angle direction is acted to vane rotor 9, the outer side surface of tip end portion 26*b* of first lock pin 26 is abutted on the rising inner side surface 24*d* on the first bottom surface 24*a*'s side so as to restrict the rotation on the retard angle side. After that, the negative torque is acted again, tip end portion 26*b* of first lock pin 26 is moved in the downward direction to second bottom surface 24*b* in accordance with the rotation of vane rotor 9 on the advance angle side as shown in FIG. 8, and engaged with second bottom surface 24*b*.

In this case, the positive torque is acted again, the outer side surface of tip end portion 26*b* is abutted on the rising inner side surface 24*b* on the second bottom surface 24*b*'s side so as to restrict the rotation on the retard angle side. That is, vane rotor 9 is automatically rotated in a sequential manner on the advance angle side by a ratchet function between first lock pin 26 and first lock hole 24.

Next, when vane rotor 9 is again rotated on the advance angle side by the negative torque, tip end portion 26*b* of first lock pin 26 is slid in the advance angle direction on second bottom surface 24*b* of first lock hole 24. The outer circumferential surface of tip end portion 26*b* is abutted on inner side surface 24*c* on the advance angle side. At the same time, second lock pin 27 is engaged with second lock hole 25, so that tip end portion 27*b* is abutted on bottom surface 25*a*, and so that the outer side surface of tip end portion 27*b* is abutted on inner side surface 25*b* on the retard angle side. With this, tip end portions 26*b* and 27*b* of first lock pin 26 and second lock pin 27 sandwich the confronting separation wall portion 41. Accordingly, vane rotor 9 is automatically held at the intermediate position between the most retard angle side and the most advance angle side. Moreover, the free rotation of vane rotor 9 on the advance angle side and on the retard angle side is restricted.

Accordingly, at the normal cold engine start, it is possible to improve the combustion by increasing the effective compression ratio of the engine during the cranking, and to improve the start-up performance, as described above.

In the valve timing control apparatus according to the first embodiment of the present invention, radial passage 38 is formed at the intermediate position circumferentially between the side surface of third vane 16*c* on the advance angle side, and first lock pin 26, and at the intermediate position of vane rotor 9 in the axial direction. That is, radial passage 33 is formed at a position sufficiently apart from first pin hole 31*a* in the circumferential direction.

With this, even when hall plug member 42 is press-fitted from the outside in radial passage 38, there is no influence of plastic deformation of first and second pin holes 31*a* and 31*b* by the press-fit. Consequently, it is possible to smoothly actuate lock pins 26 and 27.

Moreover, in the valve timing control apparatus of the conventional art, the ball plug member is provided at a position near the first and second pin holes. Accordingly, when the vane rotor is rotated from the advance angle side to the retard angle side, or when the vane rotor is rotated from the retard angle side to the advance angle side, the bah plug member is slid on the seal member mounted in the fourth shoe. Consequently, there is generated a gap between the seal member and the ball plug member, so that the retard angle hydraulic chambers and the advance angle hydraulic chambers are connected with each other. With this, the hydraulic fluid (the hydraulic pressure) is leaked. Therefore, there is generated problems such as the deterioration of the controllability and the decrease of the hydraulic pressure.

However, in the valve timing control apparatus according to the first embodiment of the present invention, as described above, radial passage 38 is formed at a position apart from pin holes 31*a* and 31*b*, that is, at the intermediate position circumferentially between the side surface of third vane 16*c* on the advance angle side and first pin hole 31*a*, and at the intermediate position of vane rotor 9 in the axial direction. Ball plug member 42 is press-fitted in the thus-formed radial passage 38. Accordingly, it is possible to prevent the leakage of the hydraulic fluid (the hydraulic pressure) caused by connecting retard angel hydraulic chambers 11 and advance angle hydraulic chambers 12, and to suppress the problems such as the deterioration of the controllability, and the decrease of the hydraulic pressure.

Moreover, in the valve timing control apparatus according to the first embodiment of the present invention, first and second stepped surfaces 26*c* and 27*c* on the tip end portion 26*b* and 27*b*'s side of first and second lock pins 26 and 27 are used as the pressure receiving surfaces for the release. Accordingly, it is possible to form the outer circumferential surfaces of pin main bodies 25*a* and 27*a* to the substantially straight cylindrical surface. Consequently, it is possible to decrease the outside diameters of lock pins 26 and 27. Therefore, it is possible to decrease the overall size of the apparatus including rotor 15. Accordingly, it is possible to improve the mountability to the engine within the engine room.

Groove passage 39*a* is formed to be constantly connected to lock holes 24 and 25, and stepped surfaces 26*c* and 27*c* at any rotational positions of vane rotor 9. Accordingly, the hydraulic pressure supplied from oil pump 20 through supply and discharge passage 33 is constantly acted to the tip end surfaces of tip end portions 26*b* and 27*b* through stepped surfaces 26*c* and 27*c* and lock holes 24 and 25.

In this way, groove passage 39*a* is constantly connected to lock holes 24 and 25 in the entire region. With this, the variations of the volumes of the all passages from supply and discharge passage 33 to lock holes 24 and 25 are not generated. That is, when these variations of the volumes of the passages are generated, the hydraulic pressures of lock holes 24 and 25 are instantaneously decreased. Lock pins 26 and 27 may be accidentally engaged with lock holes 24 and 25 by the spring forces of springs 29 and 30.

However, in the valve timing control apparatus according to the first embodiment of the present invention, it is possible to sufficiently suppress the variation of the volumes. Accordingly, the instantaneous decrease of the hydraulic pressure is suppressed. Lock pins 26 and 27 are not accidentally engaged with lock holes 24 and 25. Consequently, the free rotation conversion of vane rotor 9 on the retard angle side or the advance angle side is not blocked. Therefore, it is possible to constantly obtain the smooth rotational conversion, and to improve the response of this conversion.

Moreover, groove passage 39*a* is formed at a position which is offset in the radially inside direction from the centers of lock holes 24 and 25. Accordingly, it is possible to decrease the distance from axial passage 39*b* to lock pins 26 and 27. With this, if is possible to decrease the time periods of the releases of the engagement of lock pins 26 and 27. Moreover, it is possible to lengthen axial lengths of pin holes 31*a* and 31*b*. Accordingly, it is possible to suppress the inclinations during the actuation of lock pins 26 and 27 which are slid on pin holes 31*a* and 31*b*. Consequently, it is possible to decrease the backlashes of lock pins 26 and 27 at the intermediate phase position (the intermediate lock position).

Moreover, axial passage 39*b* is formed at a portion at which there is no influence on the manufacturing (working) of vane rotor 9. Accordingly, if is possible to suppress the decrease of the workability of vane rotor 9.

Second Embodiment

Figure 11:
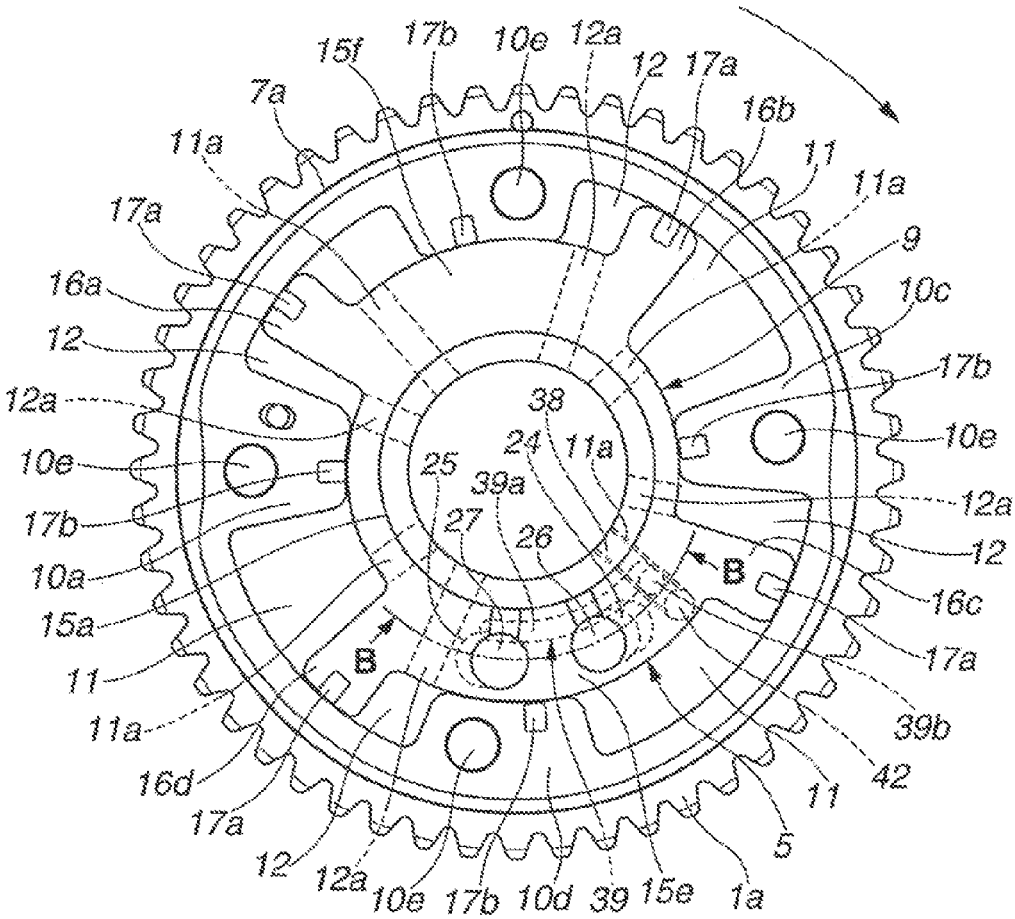
FIG. 11 is a sectional view which shows a valve timing control apparatus according to a second embodiment of the present invention, and which is taken along a section line B-B of FIG. 3.

FIG. 11 shows a valve timing control apparatus according to a second embodiment of the present invention. In this valve timing control apparatus according to the second embodiment, a second large diameter portion 15*f* is formed at a position symmetrical to the position of large diameter portion 15*e* of rotor 15 in the radial direction.

Second large diameter portion 15*f* is integrally formed between first vane 16*a* and second vane 16*b*. Moreover, second large diameter portion 15*f* is formed to connect the confronting side surfaces of both vanes 16*a* and 16*b*. Second large diameter portion 15*f* has an arc shape formed around a shaft center of rotor 15. Second large diameter portion 15*f* has a radial width which extends to a substantially central position of retard angle hydraulic chambers 11 and advance angle hydraulic chambers 12 in the radial direction, and which is substantially uniform. Second large diameter portion 15*f* has a radius of curvature which is substantially identical to that of first large diameter portion 15*e*.

Accordingly, in the valve timing control apparatus according to the second embodiment, first large diameter portion 15*e* and second large diameter portion 15*f* are formed at the symmetrical positions. Consequently, it is possible to improve the balance of the rotation of vane rotor 9, and constantly smoothly rotate vane rotor 9 between the most retard angle side and the most advance angle side. Moreover, it is possible to attain the functions and the effects which are identical to those in the first embodiment.

The present invention is not limited to the structures of the embodiments. The valve timing control apparatus is applicable to the exhaust side, in addition to the intake side.

Moreover, phase varying mechanism 3 is not limited to a structure using vane rotor 9. For example, it is optional to employ, as phase varying mechanism 3, a structure arranged to move a helical gear in the axial direction, and thereby to covert a phase.

Furthermore, the present invention is applicable to an idling stop vehicle, and a hybrid vehicle arranged to switch an electric motor and an internal combustion engine as a driving source in accordance with a driving mode of the vehicle.

[a] In the valve timing control apparatus according to the embodiments of the present invention, the groove passage of the second passage is formed in the axial side surface of the vane rotor.

[b] In the valve timing control apparatus according to the embodiments of the present invention, the axial passage of the second passage is connected to the first passage at a position apart from the seal member of the first passage in a radially inside direction.

[c] In the valve timing control apparatus according to the embodiments of the present invention, the groove passage of the second passage is formed at a position which is offset from centers of the first lock member and the second lock member in the radially inside direction.

[d] In the valve timing control apparatus according to the embodiments of the present invention, the first lock member and the second lock member are provided to the rotor.

The entire contents of Japanese Patent Application No. 2012-227927 filed Oct. 15, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine comprising:

a housing to which a rotational force is transmitted from a crank shaft, and which includes shoes formed on an inner circumference surface of the housing to protrude;

a vane rotor which includes a rotor fixed to a cam shaft, and vanes that separate advance angle hydraulic chambers and retard angle hydraulic chambers between the shoes of the housing, and which is arranged to be rotated relative to the housing on one of an advance angle side and a retard angle side by a hydraulic fluid selectively supplied and discharged to and from the advance angle hydraulic chambers and the retard angle hydraulic chambers;

a first lock member which is disposed in the vane rotor, which is arranged to be moved toward the housing by an urging force of a first urging member, and to be moved in a rearward direction against the urging force of the first urging member by receiving a hydraulic pressure, the first lock member having a first tip end;

a second lock member which is disposed in the vane rotor, which is arranged to be moved toward the housing by an urging force of a second urging member, and to be moved in a rearward direction against the urging force of the second urging member by receiving the hydraulic pressure, the second lock member having a second tip end;

a first lock recessed portion which is formed in the housing, and which the first tip end is arranged to be engageably inserted into, and thereby to restrict the vane rotor at a relative rotational position on the retard angle side relative to a position between a most advance angle position and a most retard angle position;

a second lock recessed portion which is formed in the housing, and which the second tip end is arranged to be engageably inserted into, and thereby to restrict the vane rotor at a relative rotational position on the advance angle side relative to the position at which the relative rotation on the retard angle side is restricted by the first lock member and the first lock recessed portion;

a first passage which is formed in the vane rotor, which extends in the radial direction at a position apart from the first lock member and the second lock member in the circumferential direction, which includes an opening portion located in an outer end portion of the first passage, and which receives a hydraulic pressure different from a hydraulic pressure within the advance angle hydraulic chambers and a hydraulic pressure within the retard angle hydraulic chambers;

a second passage which is connected to the first passage and hydraulic pressure receiving portions of the first lock member and the second lock member; and a seal member which is press-fit in the opening portion of the outer end portion of the first passage.

2. The valve timing control apparatus as claimed in claim 1, wherein the hydraulic pressure receiving portions of the first lock member and the second lock member are respectively formed at the first and second tip ends, which are opposite to the first and second urging members in an axial direction; the second passage is formed between an axial side surface of the vane rotor, and a sliding surface of the housing which confronts the axial side surface of the vane rotor; and the second passage includes a groove passage extending in the circumferential direction, and an axial passage which connects the groove passage and the first passage, and which extends in the axial direction of the vane rotor.

3. The valve timing control apparatus as claimed in claim 2, wherein the groove passage of the second passage is formed in the axial side surface of the vane rotor.

4. The valve timing control apparatus as claimed in claim 3, wherein the groove passage of the second passage is formed into an arc shape.

5. The valve timing control apparatus as claimed in claim 3, wherein the groove passage of the second passage has a circumferential length set so as to confront the first lock recessed portion and the second lock recessed portion from a first end portion of the groove passage on a side of the first lock member to a second end portion of the groove passage on a side of the second lock member at any relative rotational position of the vane rotor.

6. The valve timing control apparatus as claimed in claim 3, wherein the axial passage of the second passage is connected to a substantially central position of the first passage in the radial direction.

7. The valve timing control apparatus as claimed in claim 2, wherein the axial passage of the second passage is connected to the first passage at a position apart from the seal member of the first passage in a radially inside direction.

8. The valve timing control apparatus as claimed in claim 7, wherein the groove passage of the second passage is formed at a position which is offset from centers of the first lock member and the second lock member in the radially inside direction.

9. The valve timing control apparatus as claimed in claim 2, wherein the first lock member is slidably disposed within a first pin hole which is formed in the rotor, and penetrates through the rotor in the axial direction; and the second lock member is slidably disposed within a second lock hole which is formed in the rotor, and which penetrates through the rotor in the axial direction.

10. The valve timing control apparatus as claimed in claim 2, wherein the axial passage of the second passage is formed circumferentially between the first lock member and a side surface of one of the vanes which is adjacent to the first lock member.

11. The valve timing control apparatus as claimed in claim 1, wherein the first lock member and the second lock member are disposed in the rotor.

12. The valve timing control apparatus as claimed in claim 1, wherein the seal member is a ball plug member.

13. The valve timing control apparatus as claimed in claim 1, wherein the vane rotor is integrally formed with at least one large diameter portion connecting side surfaces of adjacent two of the vanes which confront each other; and the first lock member and the second lock member are provided in the large diameter portion.

14. The valve timing control apparatus as claimed in claim 13, wherein the first passage and the second passage are provided in the large diameter portion.

15. The valve timing control apparatus as claimed in claim 14, wherein the second passage is formed between an axial side surface of the vane rotor, and a sliding surface of the housing which confronts the axial side surface of the vane rotor; the second passage includes a groove passage extending in the circumferential direction, and an axial passage which connects the groove passage and the first passage, and which extends in the axial direction of the vane rotor; and the second passage is formed at a position which is offset toward a center of the rotor from the first lock member and the second lock member.

16. The valve timing control apparatus as claimed in claim 14, wherein the valve timing control apparatus comprises two large diameter portions which are positioned at symmetrical positions in the radial direction of the vane rotor.

17. A valve timing control apparatus for an internal combustion engine comprising:

a housing to which a rotational force is transmitted from a crank shaft, and which includes shoes formed on an inner circumference surface of the housing to protrude;

a vane rotor which includes a rotor fixed to a cam shaft, and vanes that separate advance angle hydraulic chambers and retard angle hydraulic chambers between the shoes of the housing, and which is arranged to be rotated relative to the housing on one of an advance angle side and a retard angle side by a hydraulic fluid selectively supplied and discharged to and from the advance angle hydraulic chambers and the retard angle hydraulic chambers;

a lock mechanism which is provided to the vane rotor, which is arranged to be abutted on the housing by being urged by an urging member, and thereby to restrict a relative rotational position of the vane rotor relative to the housing, at a position between a most advance angle position and a most retard angle position, and which is arranged to release a lock against the urging force of the urging member by receiving the a hydraulic pressure;

a first passage which is formed in the vane rotor, which extends in the radial direction at a position different from positions of a first lock member and a second lock member in the circumferential direction, which includes an opening portion located in a radially outer portion of the first passage, and which receives a hydraulic pressure different from a hydraulic pressure within the advance angle hydraulic chambers and a hydraulic pressure within the retard angle hydraulic chambers;

a second passage which is connected to the first passage and hydraulic pressure receiving portions of the first lock member and the second lock member; and a seal member which is press-fit in the opening portion of the radially outer portion of the first passage.

* * * * *